United States Patent [19]

Fishbaugh

[11] Patent Number: 4,974,489

[45] Date of Patent: Dec. 4, 1990

[54] SUPPRESSOR FOR FIREARMS

[76] Inventor: Franklin J. Fishbaugh, 4707 Upland Dr., Alexandria, Va. 22310

[21] Appl. No.: 426,159

[22] Filed: Oct. 25, 1989

[51] Int. Cl.[5] ..... F41A 21/00

[52] U.S. Cl. ..... 89/14.4

[58] Field of Search ..... 89/14.4, 14.3; 181/223

[56] References Cited

U.S. PATENT DOCUMENTS

| | | | |
|---|---|---|---|
| 981,584 | 1/1911 | Miller | 89/14.4 |
| 1,427,802 | 9/1922 | Goodwin | 181/223 |
| 1,605,864 | 11/1926 | Steinegger | 89/14.3 |
| 1,763,286 | 6/1930 | Wilman | 89/14.3 |
| 3,667,570 | 6/1972 | Werbell, III | 89/14.4 |
| 3,677,132 | 7/1972 | Plenge | 89/14.4 |
| 3,713,362 | 1/1973 | Charron | 89/14.4 |
| 4,291,610 | 9/1981 | Waiser | 89/14.4 |
| 4,384,507 | 5/1983 | Finn | 89/14.4 |
| 4,530,417 | 7/1985 | Daniel | 181/223 |

FOREIGN PATENT DOCUMENTS

| | | | |
|---|---|---|---|
| 262300 | 4/1960 | Australia | 89/14.4 |
| 151375 | 11/1937 | Austria | 181/223 |
| 652393 | 11/1962 | Canada | 89/14.3 |
| 305012 | 1/1920 | Fed. Rep. of Germany | 89/14.3 |
| 2229071 | 11/1973 | Fed. Rep. of Germany | 89/14.4 |
| 2540419 | 3/1977 | Fed. Rep. of Germany | 89/14.4 |
| 492535 | 7/1919 | France | 89/14.4 |
| 864735 | 5/1941 | France | 89/14.4 |
| 341083 | 6/1936 | Italy | 89/14.4 |
| 564536 | 6/1957 | Italy | 181/223 |
| 119153 | 3/1927 | Switzerland | 89/14.4 |
| 8153 | of 1884 | United Kingdom | 89/14.4 |
| 6701 | of 1899 | United Kingdom | 89/14.3 |

*Primary Examiner*—Charles T. Jordan
*Assistant Examiner*—Stephen Johnson

[57] ABSTRACT

A suppressor for reducing the muzzle blast and noise of firearms or like devices. Several specially configured baffles are aligned serially with intervening expansion chambers within a square tubular housing. The housing containing the baffles is aligned axially within a larger round tubular housing and held in place by an encapsulator at each end. The suppressor assembly has an internal axial passage which permits unobstructed passage of projectiles from the firearm during firing. The specially configured baffles are made of heat absorbent and heat conductive material. The serially disposed baffles shear propellant gases at differing angles forcing them away from the bullet path through openings or ports into the outer housing. The arrangement of the baffles within the square tubular inner housing provides tortuous paths for flow, dispersion and controlled expansion of gases into and along spaces between the inner and outer tubular housings and lowering the temperature of the gases to reduce audible noise and observable signature of the muzzle blast. Variant construction and assembly provides for coupling additional suppressor tube sections to extend suppressor size to accommodate additional or modified internal components to include insertion of absorbent elements of knitted, woven, sintered or compressed ferrous or nonferrous material, preferably thermally absorbent wire mesh or similar honeycombed material, in a portion of the spaces within the inner square tubular housing or between the inner and outer housings, or both, and insertion of elastic "wipes", to further control dispersion of gases, absorb heat, and moderate muzzle blast and noise.

6 Claims, 5 Drawing Sheets

SUPPRESSOR FOR FIREARMS

FIELD OF THE INVENTION

This invention relates in general to firearms, and in particular to apparatus for suppressing the muzzle blast, attendant noise and visible signature of a discharging firearm.

BACKGROUND OF THE INVENTION

Suppressors for firearms, also known as silencers, generally operate to reduce the audible noise or sharp report of a firing weapon by means of reducing and controlling the energy level of attendant propellant gases. Generally the techniques employed utilize a series of baffles which control and delay the flow, expansion and exiting of propellant gases; forcing the propellant gases to pass through various temperature absorbent materials; or a combination of these or functionally similar techniques to reduce the temperature and abrupt discharge of propellant gases. The result achieved is a corresponding reduction in the noise produced by the exiting propellant gases.

Most suppressors employ directly, with a variant, or in combination the basic techniques aforementioned to accomplish the desired function and result, and devices of such construction largely comprise the prior art. In most cases involving baffles or a variant such as helical wound screws or chambers which deflect and channel gas flow, relatively precise and costly fabrication and assembly is required. Accurate alignment and narrow tolerances required to effectively deflect propellant gases usually necessitate that metal baffles, most often circular and flat or conical in shape, be fabricated by costly machining or special forming dies. In most cases employing primarily the use of temperature absorbent materials, accumulation of spent residue from repeated firing can reduce efficiency and require cleaning or replacement of components. The metal mesh or other absorbent material can be degraded structurally by the effect of blast and heat, and become so clogged by powder residues as to severely limit gas and thermal absorptive capabilities. In the cases of suppressors employing nonpermeable rubber or other elastomer materials as baffles or "wipes" through which the projectile actually passes during firing, repeated firings cause gradual physical destruction of the baffles or "wipes" and reduced effectiveness.

Another technique requires the drilling of gas venting holes or ports either in the barrel of the firearm which becomes integral to the suppressor assembly, or the inclusion of a barrel extension or similar within the suppressor itself which is so drilled to vent propellant gases into the suppressor and slow projectile velocity to a subsonic level, reducing both blast and sonic noise generated by modern high velocity ammunition. Such devices may also employ a combination of the aforementioned techniques to further aid reduction of noise. Where such devices are made integral to a firearm the suppressor is usually limited to use on a single firearm. Where the firearm barrel is modified through drilling, the firearm itself is rendered unsuitable for practical use without the integral suppressor in place.

SUMMARY OF INVENTION

The suppressor of the present invention reduces the energy of propellant gases, and achieves a corresponding reduction of associated firing noise and signature, by specially configured heat absorbent and heat conductive baffles serially disposed within a square tubular housing of heat absorbent and heat conductive material mounted concentrically within a larger heat absorbent tubular housing which forms a casement attachable to the muzzle of the firearm. A variant provides for insertion of individual shaped elements of absorbent material within internal structural cavities of the suppressor assembly so placed as to permit passage of propellant gases into and through the absorbent elements, enhancing the noise suppression capability through improved heat absorption from the propellant. Effective functioning of the present invention is not dependent however upon the use of the aforementioned absorbent elements which serve rather to augment effectiveness when used.

Stated specifically, suppressors according to the present invention rely basically upon the uniquely configured system of baffles to contain, deflect, control and disperse gases associated with the firearm firing. It is believed that the oppositely opposed angles of the baffles effectly shear away propellant gases from the projectile path, forcing said gases over a heat conductive structure and into controlled expansion areas. Successive baffles serially disposed at differing angles repeat the process of shearing off gases, substantially eliminating the presence of any significant gas energy immediately behind the exiting projectile at the moment of firing. The channeled gases expand within intervening open spaces between the baffles inside the inner tubular housing and spaces defined by the inner and outer tubular housings, having been forced into such spaces by the shearing effect of the baffles and adjacent ports or openings in the inner tubular housing. The gases reenter the inner tubular housing through the same ports or openings through which they were initially forced outward and pass into the successive serially disposed baffles and expansion spaces. The shearing, dispersal, expansion and reentry process is repeated until the gases eventually exit by way of the internal axial passage provided for the projectile, leaving the suppressor assembly with greatly diminished energy, reduced noise and negligible observable signature.

Unique to the present invention is the shape and placement of the special baffles which enable highly efficient shearing of propellant gases to channel and reduce gas energy. An advantage is that a high level of effectiveness is obtained without resorting to extreme tolerances in fabricating the system of baffles. The baffles are comprised of two flat surfaces which angle outward from the internal axial passage to ports or openings in two of the outer walls of the inner square tubular housing. The apex at the juncture of the two flat surfaces of the baffle contains a centered hole which serves as a passageway for the projectile. Arranged serially within the inner square tubular housing, each successive set of angled baffles is disposed so as to force propellent gases to be vented from different walls and openings of the housing than employed for the immediately preceeding baffle. It is believed the countervailing effect of the previous vented gases and those vented by differently disposed successive baffles aid in dissipating blast energy and associated noise. This function likewise effectively negates blast properities such as visible flash and smoke which otherwise could freely exit the suppressor as an observable signature of a firing weapon. This would be especially significant in cases involving use of high volume weapons fire such as repeated firing from a fixed point or use of an automatic weapon at night or when risk of detection is a factor.

Unique also to the present invention is the alternative construction method of internally threading one end of the outer suppressor tube or casement and while providing external threads at the other end, allowing for extending the suppressor size by coupling additional tubes with like thread fittings. Such extension could accommodate additional or modified internal components for higher efficiency or for special weapon applications.

Accordingly, it is an object of the present invention to provide an improved suppressor for firearms or the like.

It is another object of the present invention to provide a suppressor which allows generous tolerences in construction without sacrificing effectiveness of operation.

It is still another object of the present invention to provide a suppressor which achieves a high level of effectiveness without the need to employ absorbent meshes or packing materials or the use of elastic "wipes" which must necessarily be cleaned or replaced after repeated usage. However, the present invention may be optionally fitted with inserts of such materials as an adjunct to normal operation to further moderate weapon blast and enhance sound reduction properties of the unit.

It is still another object of the present invention to provide a suppressor of intentional design that lends itself readily to fabrication for various calibers or conversion from one caliber to another by means of substituting different preassembled "core" elements having internal axial passageways of appropriate size.

It is still another object of the present invention to provide a suppressor which functions in such a manner as to optimize gas dispersion throughout the interior of the suppressor assembly to greatly reduce the abrupt discharge and energy of propellent gases, thereby achieving not only a significant noise reduction but eliminating or greatly reducing visible signatures such as smoke and muzzle flash.

It is still another object of the present invention to provide a suppressor allowing intentional alternative construction of the outer suppressor tube or casing to accommodate coupling of additional outer tube sections to permit expansion of the suppressor size and use of additional or modified internal components for enhanced performance or special weapon applications.

DETAILED DESCRIPTION OF PREFERRED EMBODIMENT

Figure 1:
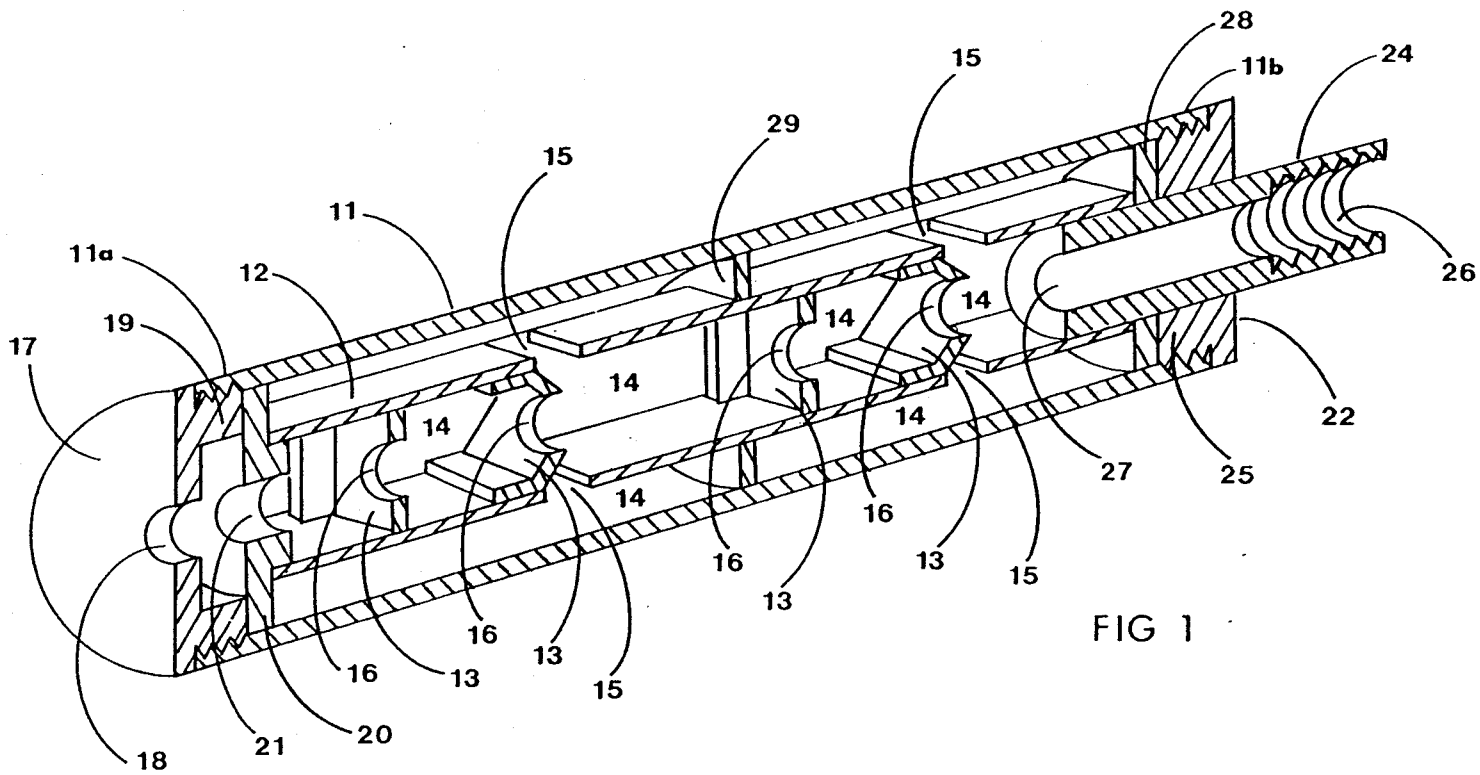
FIG. 1 is a pictorial view showing a suppressor according to a preferred embodiment of the present invention, and having a portion of the suppressor housing cut away for illustrative purposes.

Turning first to FIG. 1, there is shown at 10 a suppressor designed to be attachable to the muzzle of a firearm (not shown) such as a handgun or rifle. The particular disclosed suppressor embodiment 10 is designed for use with a firearm firing a single projectile with each discharge of a cartridge and is not intended nor suited for use on a firearm discharging multiple projectiles with each shot, such as a shotgun. Otherwise, it should be understood that the choice of firearm, bore or caliber, and cartridge configuration is not critical to the present invention.

Figure 6:
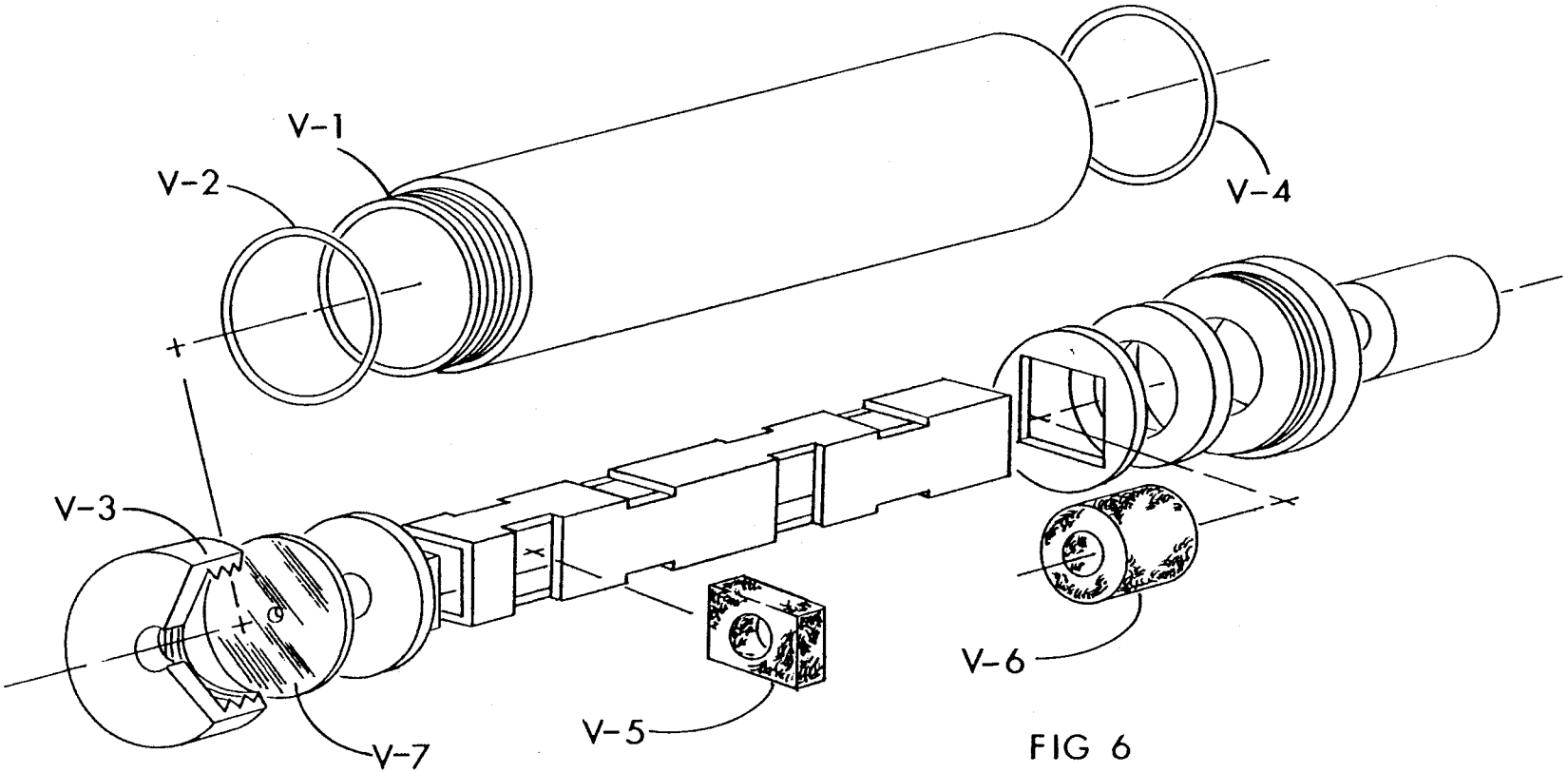
FIG. 6 is an exploded view of the suppressor shown in FIG. 1 and FIG. 2, with certain components shown broken away to illustrate features representing alternative construction and assembly, to include various inserts which may be optionally used in the suppressor to augment its capabilities.

The suppressor 10 shown at FIG. 1 consists of the following main components which comprise the external and internal structure of the silencer and accomplish the desired objective of reducing noise and blast signature during firing:

11 is a heat absorbent cylindrical tubular housing which forms the outer tube or casement for the suppressor assembly. The forward end body portion 11*a* and the rearward end body portion 11*b* of the tubular housing are internally threaded for fitting of a forward encapsulator 17 and a rear encapsulator 22. (Alternatively, as shown in FIG. 6 the rear end of the tubular housing 11 could be internally threaded as already described and the forward end V-1 externally threaded, or vice-versa, allowing for the joining of additional tube sections of similar construction to extend the overall suppressor and allow for additional and modified internal components.) This housing is shown as a separate component in the exploded view in FIG. 2, and is shown in a cross-section side view in FIG. 3.

Figure 2:
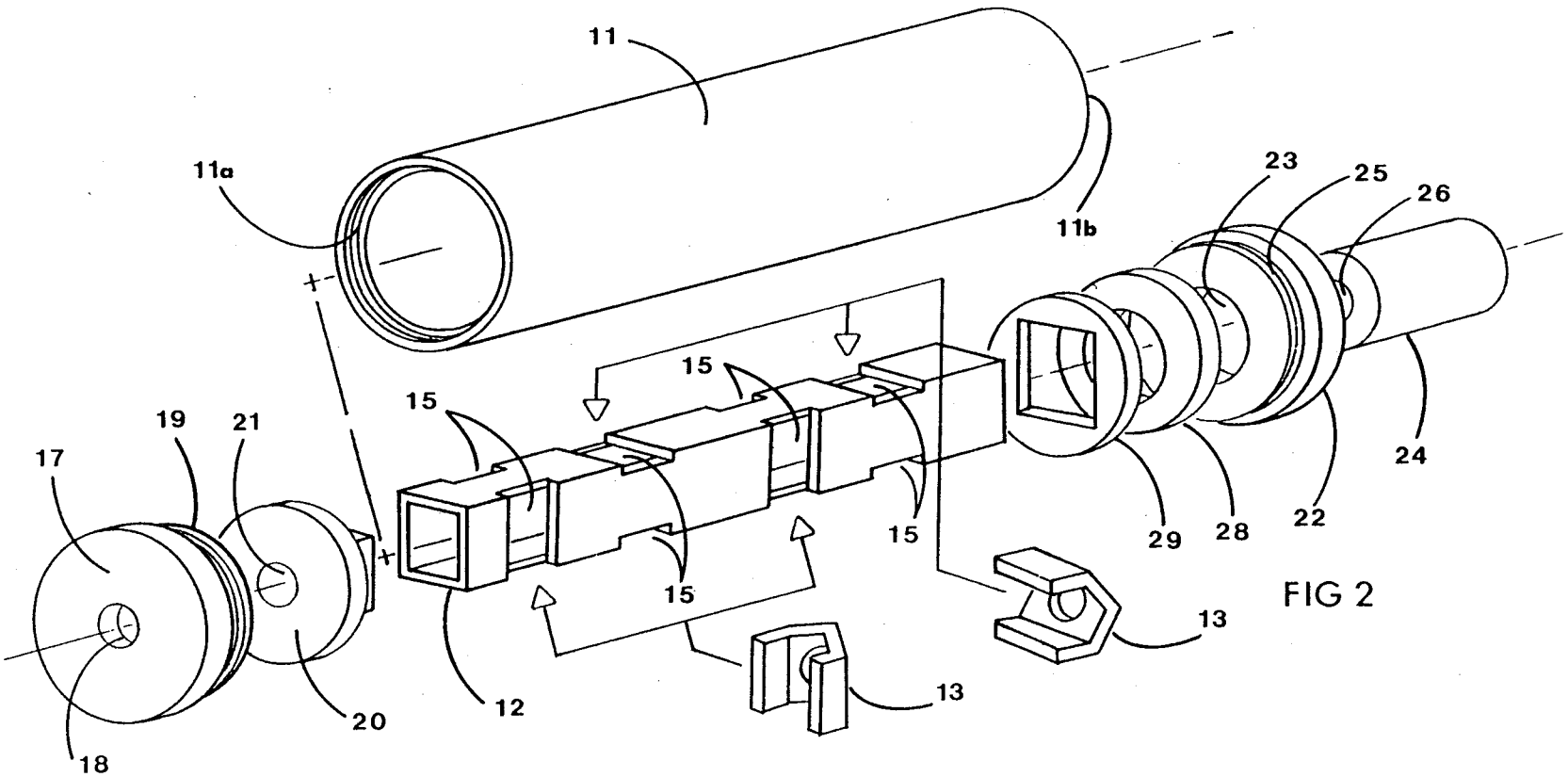
FIG. 2 is an exploded view of the suppressor shown in FIG. 1, with certain components shown broken away for illustration.

12 is a square tubular housing of heat absorbent and heat conductive material which forms an inner housing and frame for mounting the baffling members 13 and ensuring alignment of same. Portions of the housing wall serve to define expansion areas 14 and openings or ports 15 for controlled flow and dispersion of propellant gases. This square tubular housing is best seen in the pictorial cutaway view in FIG. 1 and as a separate component in FIG. 3. The expansion areas may be seen in FIG. 1 and FIG. 3. The ports are best seen in FIG. 1 and FIG. 2.

Figure 3:
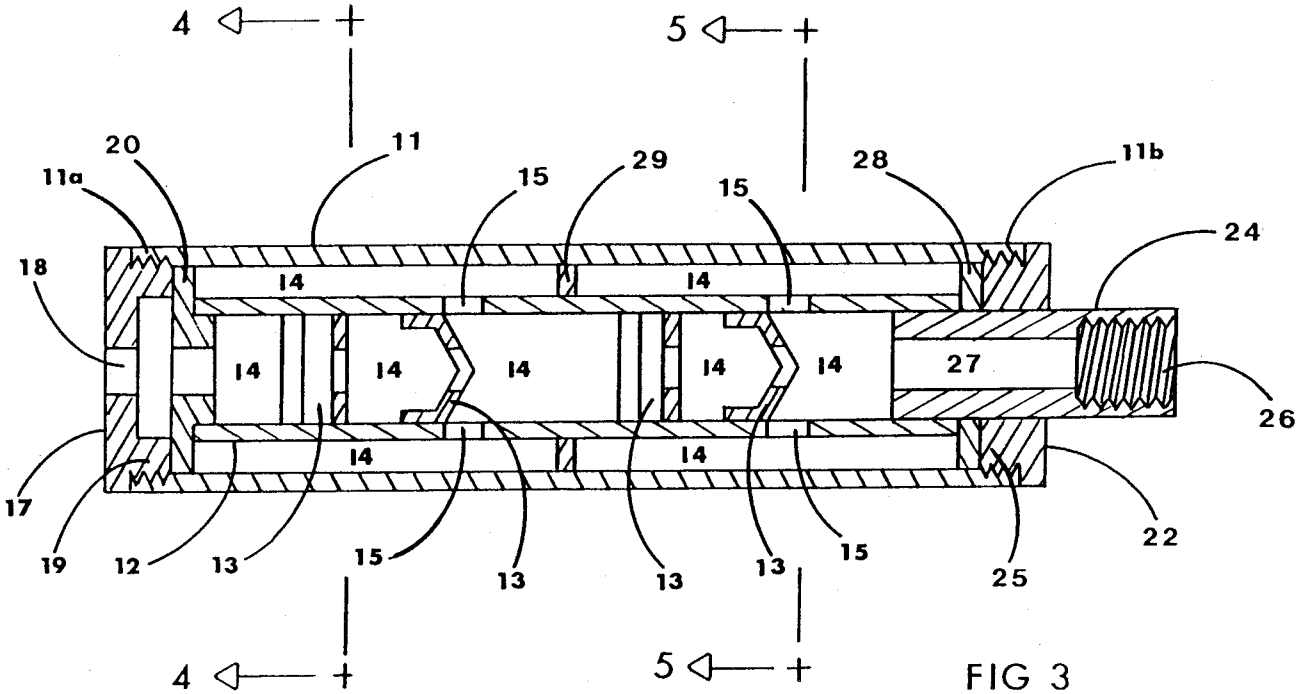
FIG. 3 is a longitudinal section view of the suppressor shown in FIG. 1.
Figure 5:
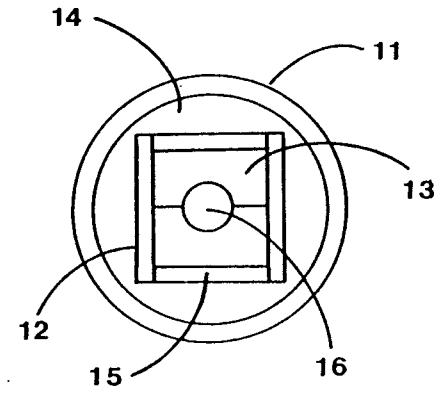
FIG. 5 is a transverse section view taken along line B - B of FIG. 3.
Figure 4:
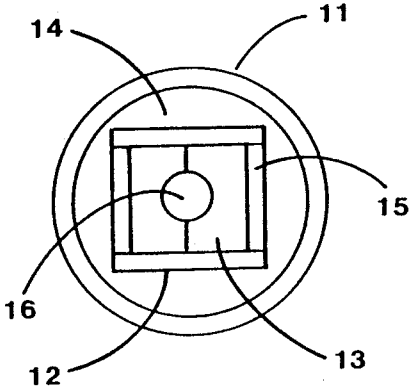
FIG. 4 is a transverse section view taken along line A - A of FIG. 3.

13 is a specially shaped baffle element of heat absorbent and heat conductive material which is angled from an apex outward from the center point of the square inner tubular housing 12 in which it is mounted. The angle employed is approximately 45 degrees off the internal axial passageway through which the projectile passes. The baffle element 13 contains a hole 16 through its center coincident with the internal axial passageway of the suppressor assembly and adequate to accommodate passage of the projectile. Four such baffles 13 are employed in the particular disclosed embodiment shown in FIG. 1–3, however the number used could be varied with a corresponding change in silencer efficiency. Detailed views of the baffle components are shown in FIG. 2. A cutaway view showing placement of the baffles is seen in FIG. 1 and are shown in a cross-section view in FIG. 3. Transverse section views in FIG. 4 and FIG. 5 depict the baffle surfaces which face the muzzle of the weapon and which are serially disposed to force propellent gases alternately through opposite openings or ports 15 in the square inner tubular housing 12.

17 is the forward encapsulator which encloses the forward end of the suppressor outer housing or casement 11 from which the projectile exits. The encapsulator 17 contains a hole 18 through its center coincident with the internal axial passageway of the suppressor assembly and adequate to accommodate passage of the projectile. (To enhance sealing of propellant gases, the encapsulator 17 may be optionally fitted with a rubber "o" ring gasket V-2 or similar at its point of closure with the outer suppressor housing 11. This is shown in FIG. 6.) The encapsulator 17 has a body portion 19 externally threaded to fit the internally threaded forward end of the outer suppressor housing 11. (In an alternative version, the encapuslator may have a body portion V-3 internally threaded to match the externally threaded forward end of the suppressor housing 11. This is shown in FIG. 6.) The encapsulator may be seen in cutaway pictorial view in FIG. 1 and in a cross-section view in FIG. 3. The encapsulator is shown as a separate component in FIG. 2.

20 is a flat washer fabricated on one side to match exactly the forward end opening of the square inner tubular housing 12 and hold same in center alignment within the outer suppressor housing 11 when the forward end encapuslator 17 is fitted in place. The washer unit 20 contains a hole 21 through its center coincident with the internal axial passageway of the suppressor assembly and adequate to accommodate passage of the projectile. The washer is shown as a separate component in the exploded view in FIG. 2 and in a cross-section view in FIG. 3.

22 is the rear encapsulator which encloses the end of the outer suppressor housing 11 which attaches to the firearm. The encapsulator 22 contains a hole 23 through its center for the muzzle fitting 24 which is centrally mounted in the inner square tubular housing 12 and extends to the rear through the rear encapsulator 22. (To enhance sealing of propellant gases, the rear encapsulator 22 may be optionally fitted with a rubber "o" ring or similar V-4 at its point of closure with the outer suppressor housing 11. This is shown in FIG. 6.) The encapsulator 22 has a body portion externally threaded to fit the internally threaded rear end of the outer suppressor housing 11. The encapsulator is seen in the cutaway pictorial view in FIG. 1, as a separate component in FIG. 2, and in a cross-section view in FIG. 3.

24 is a machined fitting which mounts into the inner square tubular housing 12 and has a portion internally threaded at its rearward end adequate for attachment to the muzzle of a firearm. (It is understood that the internally threaded dimensions of the attachment portion must be compatible with the externally threaded muzzle portion of the firearm being used or vice-versa.) This fitting 24 is firmly fixed inside the inner square tubular housing 12 which it holds in center alignment by means of the rearward section of the fitting 24 extending through the center hole 23 of the rear encapsulator 22. This fitting 24 has a hole 27 bored through its length coincident with the internal axial passageway of the suppressor assembly and adequate to permit passage of the projectile. The muzzle fitting is best seen in the pictorial cutaway view in FIG. 1 and in the longitudional cross-section view in FIG. 3.

28 is a washer which fits inside the outer suppressor housing 11 and abutts the rear end of the inner square tubular housing 12 and the inner lip or face of the rear encapsulator 22 so as to form a barrier against dispersal of gases and serve as a further aid to ensure center alignment of the inner tubular housing 12. The washer 28 has a center hole concident with the internal axial passageway of the suppressor and adequate to accommodate the rearward portion of the machined attachment fitting 24 which extends from within the inner square tubular housing 12 through the washer 28 and through the center hole 23 in the rear encapsulator 22. The washer is best seen in the pictorial cutaway view in FIG. 1 and as a separate component in FIG. 2. A cross-section view is shown in FIG. 3.

29 is a washer which fits over the inner square tubular housing 12 at its midpoint within the suppressor assembly and is fixed in place so as to form a barrier or wall defining forward and rearward expansion spaces between the inner square tubular housing 12 and the outer suppressor housing 11. The washer 29 likewise aids in maintaining center alignment of the inner square tubular housing 12. Although only one such washer 29 is shown in the particular disclosed embodiment, it is understood that additional washers may be employed with corresponding change in suppressor efficiency. The washer is shown in the pictorial cutaway view in FIG. 1 and is best seen in the exploded view in FIG. 2. A cross-section view is shown in FIG. 3.

When a firearm fitted with the suppressor 10 is fired, the bullet serially passes through the several suppressor expansion chambers defined by the separate angularly configured baffles 13 fixed within the inner square tubular housing 12. The expanding propellent gases immediately behind the bullet are diverted from their forward path by the shearing effect of the angled baffles. The gases both expand within the expansion chambers defined within the inner square tubular housing 12 and the expansion areas between the square tubular housing and the external casing 11 of the suppressor assembly. The gases pass from the square tubular housing to the outer expansion areas through openings or ports 15 in the square tubular housing located adjacent to each baffle element. Each succeeding baffle element is rotated ninety degrees within the square tubular housing causing a ninety degree shift in the angle of flow and dispersion of the propellent gases as they pass serially through each expansion chamber and baffle assembly. This provides tortuous and countervailing passages which direct the gases over the heat-absorbent square tubular housing and baffle elements, lowering the temperature of the propellent gases. This results in reduced energy and blast so that the noise or report of firing is moderated or significantly suppressed as the the bullet exits through the internal axial passageway of the assembly and out the opening 18 in the encapsulator 17 at the front of the suppressor. The special configuration of the baffles and the shearing and dispersal of gases into countervailing paths of flow which alternately change direction and permit re-expansion into succeeding sections of the suppressor assembly likewise serve to reduce completely or to negligible levels any observable signatures normally evident at the moment of firing, such as flash or smoke.

The use of the separate expansion areas 14 and shaped baffle elements 13 in the inner square tubular housing 12 with additional expansion areas between the square housing and the external suppressor casing 11 improves the gas dispersal and energy absorbing capability of the suppressor. The exposed flat surfaces of the angled baffles present greater heat absorbent and conductive surface area than the usual circular baffles employed in conventional suppressors. Similarly, the exposed flat surfaces of the square inner tubular housing provide still further heat absorbent capacity which is uniquely enhanced by the direction of gas flow into the secondary expansion areas between the inner tubular housing and the suppressor casing 11 allowing for yet further absorption along the exterior surface of the inner housing and the interior surface of the suppressor casing. The distinct advantage of this means to disperse, cool and control propellent gases is that mesh wraps or packing elements are not essential to the present invention to absorb gases and heat. This consequently eliminates the need for periodic replacement of such elements and associated maintenance required in conventional suppressors as such elements deteriorate. A second distinct advantage is that moderation of blast and control of dispersing gases is accomplished by the baffle configuration and inner tubular housing arrangement without the need for elastic "wipes" which degrade accuracy and are abraded by the passage of bullets during repeated firings. Consequently, associated maintenance and the need to replace such "wipes" is also avoided.

It is understood that while the design of the present invention obviates the need for heat absorbing mesh and gas-trapping "wipes" described above, it may be optionally fitted with honeycombed or compressed mesh wraps, elastic "wipes" or similar inserts to further augment blast moderation and noise suppression. These conventional components and their functionality have been common to many suppressor designs and variants dating from at least World War II. In the present invention they would need only to be of suitable configuration to fitted within the described suppressor assembly. Representative examples of such mesh type inserts V-5 and V-6 and their placement in the suppressor are shown in FIG. 6. Similarly, a conventional type "wipe" V-7 of nonpermeable rubber or other elastomer could be fitted as shown in FIG. 6.

It should be understood that the foregoing pertains only to a disclosed embodiment of the present invention, and that numerous changes and modifications therein may be made without departing from the spirit or scope of the invention as set forth in the following claims:

I claim:

1. A sound suppressor designed to be mounted on a firearm, comprising:

an outer tubular housing of heat absorbent material attachable to the firearm and defining a hollow interior space within which is fitted an inner square housing of heat absorbent and heat conductive material surrounding a second hollow interior space which accommodates the bullet path along which bullets travel, said outer tubular housing being closed at each end by two threadably affixed encapsulators, each of the said encapsulators containing an opening coincident with and accommodating said bullet path along which bullets travel, and one said encapsulator accommodating attachment means for attachment to the firearm;

plural baffle elements of heat absorbent and heat conductive material serially disposed along the said second hollow interior space within said inner square housing, and each of said plural baffle elements having an opening therein coincident with and accommodating said bullet path along which bullets travel;

plural expansion chambers serially disposed within said inner square housing and defined by the interior walls of said inner square housing and forwardly facing and rearwardly facing walls of said plural baffle elements;

plural and serially disposed secondary expansion areas defined by the exterior walls of said inner square housing, the interior wall of said outer tubular housing, and the forwardly facing and rearwardly facing walls of at least one encircling washer fixed to said exterior walls of said inner square housing so as to create said plural and serially disposed secondary expansion areas in said hollow interior space between the said outer tubular housing and the said inner square housing;

said inner square housing of heat absorbent and heat conductive material formed as an elongated housing with four walls of identical width and identical length, with plural openings disposed serially in each of the said walls of said inner square housing, said plural openings being of exactly equal size and disposed diameterical to each other in the said walls of said inner square housing and between the said plural baffle elements disposed serially within said inner square housing, the said plural openings alternating between said walls of said inner square housing and between the said plural baffle elements so that the said plural openings at each location are ninety degrees rotated from the next adjacent said plural openings so as to permit said plural expansion chambers serially disposed within said inner square housing to communicate through the said plural openings in the said walls of the said inner square housing with the said plural and serially disposed secondary expansion areas.

2. Suppressor apparatus as in claim 1, wherein:

said plural baffle elements are identically configured to have two flat surfaces which obstruct and deflect propellent gases, each of the said two flat surfaces of each of the said plural baffle elements being of identical width and identical length, and each of the said two flat surfaces formed to angle equally from an apex located coincident with the said bullet path along which bullets travel so that the identical said two flat surfaces cause equal quantities of said propellent gases to be deflected from the said bullet path along which bullets travel.

3. Suppressor apparatus as in claim 2, wherein:

said plural baffle elements are disposed serially within said inner square housing so that the said two flat surfaces of the said plural baffle elements are aligned with the said plural openings in the said inner square housing and abut the said interior walls of the said inner square housing adjacent to the said plural openings so as to precisely deflect said propellent gases through said plural openings.

4. Suppressor apparatus as in claim 11, wherein:

said plural baffle elements have a rectangular outer surface in contact with the said interior walls of the said inner square housing so that the said outer surface of each of the said plural baffle elements abuts the said interior walls of said inner square housing, so that each of the said plural baffle elements obstructs and deflects said propellent gases except for the said opening in each of the said plural baffles coincident with and accommodating said bullet path along which bullets travel.

5. A sound suppressor designed to be mounted on a firearm, comprising:

an outer tubular housing of heat absorbent material attachable to the firearm and defining a hollow interior space within which is fitted an inner square housing of heat absorbent and heat conductive material surrounding a second hollow interior space which accommodates the bullet path along which bullets travel, said outer tubular housing being closed at each end by two threadably affixed encapsulators, each of the said encapsulators containing an opening coincident with and accommodating said bullet path along which bullets travel, and one said encapsulator accommodating attachment means for attachment to the firearm;

plural baffle elements of heat abosrbent and heat conductive material serially disposed along the said second hollow interior space within said inner square housing, and each of said plural baffle elements having an opening therein coincident with and accommodating said bullet path along which bullets travel;

plural expansion chambers serially disposed within said inner square housing and defined by the interior walls of said inner square housing and forwardly facing and rearwardly facing walls of said plural baffle elements;

plural and serially disposed secondary expansion areas defined by the exterior walls of said inner square housing and by the interior walls of said outer tubular housing and the forwardly facing and rearwardly facing walls of at least one encircling washer fixed to said exterior walls of said inner square housing so as to create said plural and serially disposed secondary expansion areas in said hollow interior space between the said outer tubular housing and the said inner square housing;

said plural expansion chambers serially disposed within said inner square housing provide successive gas-receiving spaces to dissipate propellent gases, and provide optimum contact of said propellent gases with the said interior walls of said inner square housing of said heat absorbent and heat conductive material and provide optimum contact of said propellant gases with said forwardly facing and rearwardly facing walls of said plural baffle elements of said heat absorbent and heat conductive material, so as to absorb and conduct away heat from the said propellent gases as said propellent gases are deflected by the said plural baffle elements from the said bullet path along which bullets travel.

6. Suppressor apparatus as in claim 5, wherein:

said plural and serially disposed secondary expansion areas provide gas-receiving spaces to further dissipate said propellent gases deflected from the said plural expansion chambers serially disposed within the said inner square housing, and provide optimum contact of said propellent gases with said exterior walls of said inner square housing of said heat absorbent and heat conductive material and said interior walls of said outer tubular housing of said heat absorbent material, so as to further reduce heat of the said propellent gases.

* * * * *